US005174227A

United States Patent [19]

Frye et al.

[11] Patent Number: 5,174,227

[45] Date of Patent: Dec. 29, 1992

[54] EXTENDED POST SEWING MACHINE

[75] Inventors: Ricky J. Frye, Miamisburg; Gary L. Hendricks, Beavercreek, both of Ohio

[73] Assignee: Mim Industries, Inc., Miamisburg, Ohio

[21] Appl. No.: 694,931

[22] Filed: May 2, 1991

[51] Int. Cl.[5] ..... D05B 13/00; D05B 35/00

[52] U.S. Cl. ..... 112/10; 112/260; 112/136; 112/262.1

[58] Field of Search ..... 112/62, 260, 54, 258, 112/259, 10, 136, 153, 262.1

[56] References Cited

U.S. PATENT DOCUMENTS

| | | | |
|---|---|---|---|
| 1,188,387 | 6/1916 | Bates | 112/62 X |
| 2,354,468 | 7/1944 | Like | 112/62 |
| 2,363,976 | 11/1944 | Kline | 112/62 |
| 2,742,005 | 4/1956 | Quinn | 112/62 X |

*Primary Examiner*—Werner H. Schroeder
*Assistant Examiner*—Paul C. Lewis
*Attorney, Agent, or Firm*—Joseph G. Nauman

[57] ABSTRACT

A sewing machine, capable of at least partial automatic operation, performs a second stitched seam, e.g. a deck seam, about joined ends of a pair of fabric panels which are components of an air bag. The machine features a vertically extended pedestal supporting the sewing head and a corresponding veritcally extended post supporting the plate beneath the head. The post supports the joined bag panels draped around it with the joint of the draped panels located between the sewing head and plate for stitching the edges of the panels to one of the panels while the remainder of the panels hang vertically around the post. A fixed lower guide plate and retractable upper guides are provided which will move a previously made stitched perimeter joint in the panels into precise spaced relation with a sewing head, so as to stitch the materials outside the first seam to each other and to one of the panels, forming the deck seam. The lower guide plates and upper guide members align the previously made joint with the sewing head, and fold the edges of the material onto one of the fabric panels before the materials enter the sewing head. The upper guide members are positioned and retracted under power to facilitate the process of setting a job into the machine, and to assure precise alignment of the guides. The machine also includes a powered feed device which pulls the guided materials through the sewing head, and a programmable controller device to allow measurement of and control over the extent of the deck seam formed by the machine.

12 Claims, 6 Drawing Sheets

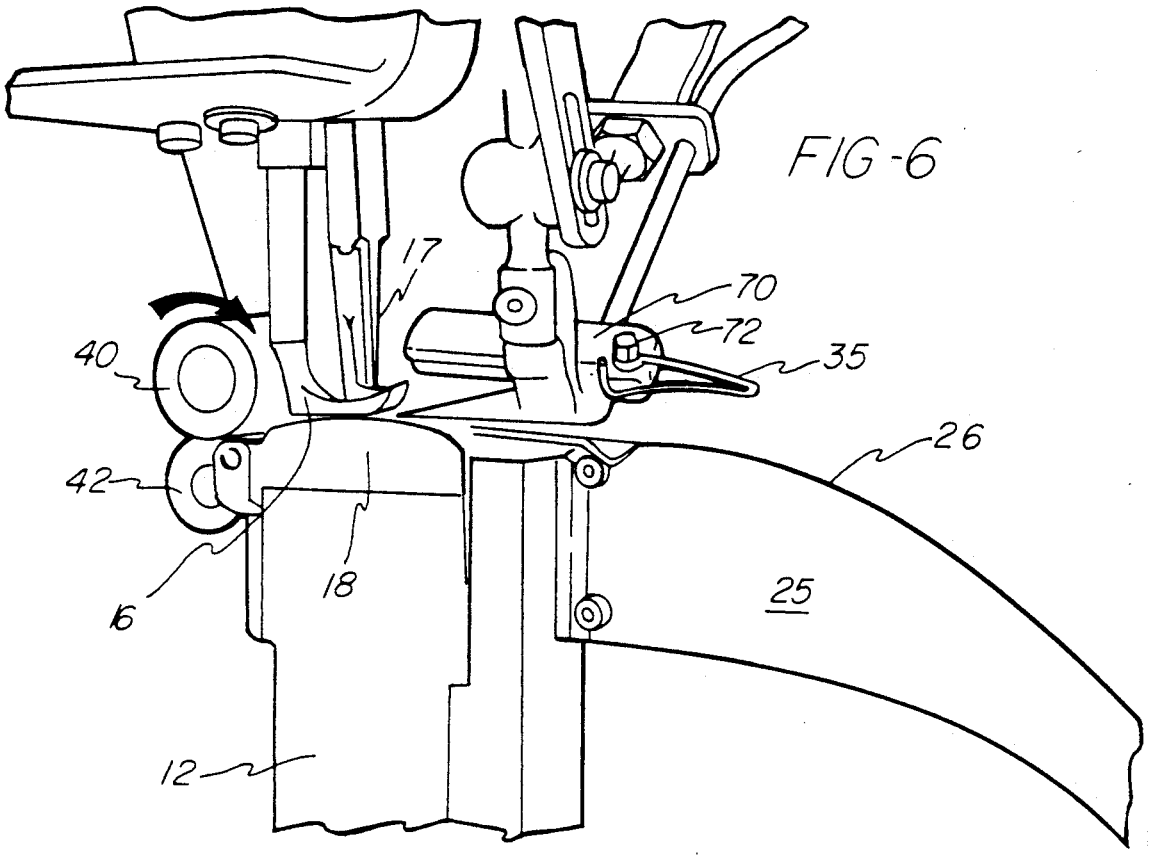
FIG-6
FIG-7
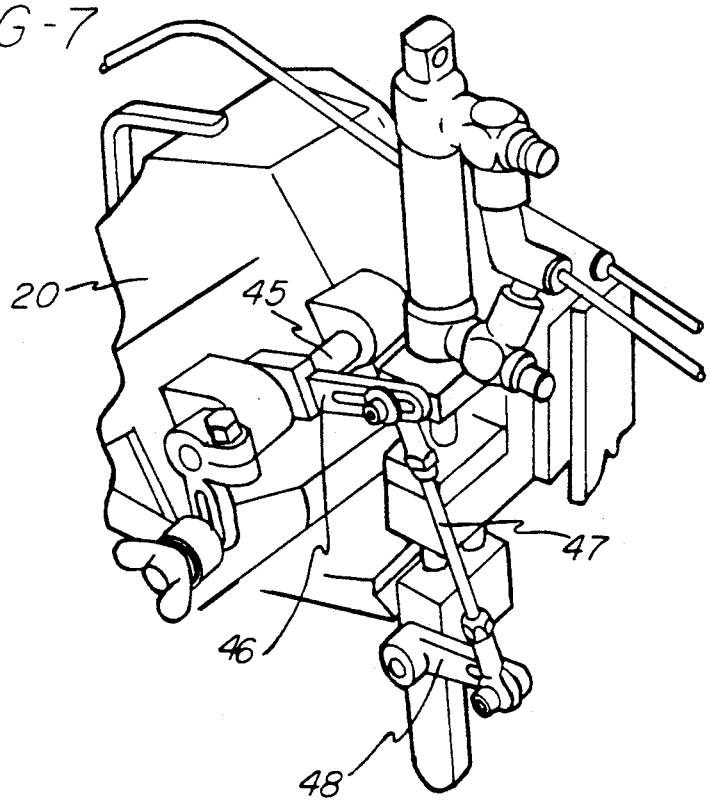

EXTENDED POST SEWING MACHINE

BACKGROUND OF THE INVENTION

This application relates to a specialized sewing machine and method, and particularly to a machine of the type known as a "post" machine, but with a vertically extended post structure, to perform operations such a deck seam.

Such a machine is of unique utility in the automated making of a so-called deck seam around the periphery of a relatively large annular shaped multi-piece fabric member, such as a safety "air bag" for automotive use. Such bags are per se known, and comprise an annular (toroidal shaped) collapsible bag which is secured at its center to a strategic location in a vehicle, such as at the center of a steering wheel, and which includes a quick inflation device responsive to high deceleration of the vehicle to inflate in front of the driver (or passenger) and protect him from injury in an accident. The bags must store in a relatively small space, be dormant for long periods of time, and then function when needed with a high degree of reliability.

The "air" used to inflate these safety bags is in reality a pressurized gas coming from a small high pressure inflator. The fabric of the bag must fit the storage space allotted, inflate to the desired shape under considerable internal pressure, and then release so the protected party will not be trapped in a damaged vehicle by the inflated bag. The fabric is a high strength cloth (usually a closely woven nylon cloth) impregnated with a suitable gas-impervious rubber-like material, and is manufactured by sewing together multiple pieces of such fabric. Obviously the seams at which these fabric parts are joined must also be made with care and precision.

A typical completed air bag has as two of its major parts generally circular front and back panels joined at their periphery by what is known as a deck seam. These panels may have a diameter in the order of 28 to 30 inches (71 to 76 cm.). The front panel is the one which will deploy against the person to be protected, and the back panel is the one anchored to the vehicle via a per se known annular anchoring device of much smaller diameter, secured to the back panel at an opening near its center. It is through this opening that the gas generator inflates the bag during use.

The two panels are stitched preliminarily together around their entire peripheries, by what is usually called a perimeter seam. Next, to form the deck seam, the bands of the panel material outward of this initial seam are then folded over onto one of the panels, usually the front panel, and both outer bands of material are stitched to the panel onto which they are folded. It is important that this second stitched seam be uniformly spaced from the first seam, and be continuous around the two panels, so the resulting closed periphery of the air bag does not leak or burst anywhere around this seam and hamper the deployment and positioning of the bag when it is suddenly needed.

As can be appreciated, the post of the stitching head of a machine making this stitch must reach into the bag interior through the much smaller opening in the back panel. In the meantime, the rest of the bag material must be kept away from the peripheral area and controlled so as not to interfere with the progress of the deck seam operation. Once the dimensions and parameters of the deck seaming job are determined, it is a repetitive operation, thus it can be automated to some extent to assure continued precision of the seaming, and to minimize operator involvement in the control of the bag material.

Post type machines are known, however the usual height of the post, to which the bobbin and feeding dog are mounted, and from which they are driven, is in the order of 6 to 7 inches, which in the case of these larger panels leaves a substantial part of such panels bunched around the bottom of the post and the base of the machine. This in turn presents a handling problem to an operator, and tends to interfere with any attempt to automate, at least partially, this operation.

SUMMARY OF THE INVENTION

The invention provides a specialized machine which has a relatively high, vertically extended, post over which is mounted a conventional sewing head. The drive mechanism from the motor is extended through the base of the machine and upward into this extended post, whereby the upper surface of the post can receive the attached front and back panels of the bag and loosely hold the bag, by extending through the central opening in the back panel. This allows the joint of the panels to "rotate" through the head as the deck seaming proceeds, with the remainder of the panels draped generally vertically from the extended post. In the operation described above, the post and the vertical part of the machine housing are extended approximately four time their usual dimension, so the post is in the order of 28 inches tall.

A lower guide plate projects downwardly and forwardly from the top of the post, at the bottom of the head, and fits the inside of the first or preliminary seam in the panels, to space and align it with respect to the presser foot of the sewing head. A first retractable guide plate is supported at the side of the head opposite the lower guide plate, and functions to guide the adjoining peripheral bands of bag material onto the underlying part of the front panel, so the deck seam can be made through them and the front panel. A further or second retractable guide is supported at the opposite side of the head from the first retractable guide plate, and functions to guide the peripheral bands onto the first retractable guide plate, and thus into precise alignment with the sewing head.

At the rear of the sewing head is a set of feed wheels one of which is power driven. These wheels press the sewn periphery of the panels between them, and pull that material through the sewing head in a uniform manner. These feed wheels can have a control mechanism associated with them, so as to determine the length of stitch for the continuous deck seam made by the head. The machine preferably also employs a stitch counting system which is electronically controlled through the drive motor. This allows the machine to count the required number of stitches for the periphery of the workpiece. When that length equals the peripheral measurement of the bag, the machine can be automatically halted.

It is therefore the primary object of this invention to provide a sewing machine apparatus which will perform a second stitched seam about joined ends of a pair of fabric panels; to provide such a machine which will guide a previously made stitched joint in the panels into precise spaced relation with a sewing head, so as to stitch the materials outside the first seam to each other, and to one of the panels, forming a deck seam; to provide such a machine including guide plates and members which align the previously made joint with the sewing head, and fold the edges of the material onto one of the fabric panels before the materials enter the sewing head; to provide such a machine wherein at least some of the guide members are positioned and retracted under power to facilitate the process of setting a job into the machine, and to assure precise alignment of the guides; to provide such a machine which includes a powered feed device which pulls the guided materials through the sewing head, and which may include a programmable device to allow measurement of and control over the extent of the deck seam formed by the machine.

Other objects and advantages of the invention will be apparent from the following description, the accompanying drawings and the appended claims.

BRIEF DESCRIPTION OF THE DRAWINGS

FIG. 6 is a partial perspective view from the left of FIG. 4, showing the top of the head, the various guides, and the feeding rollers at the rear of the head;

FIG. 7 is a perspective view taken from the rear of FIG. 6, showing the drive to the feed wheel.

DESCRIPTION OF THE PREFERRED EMBODIMENT

Figure 1:
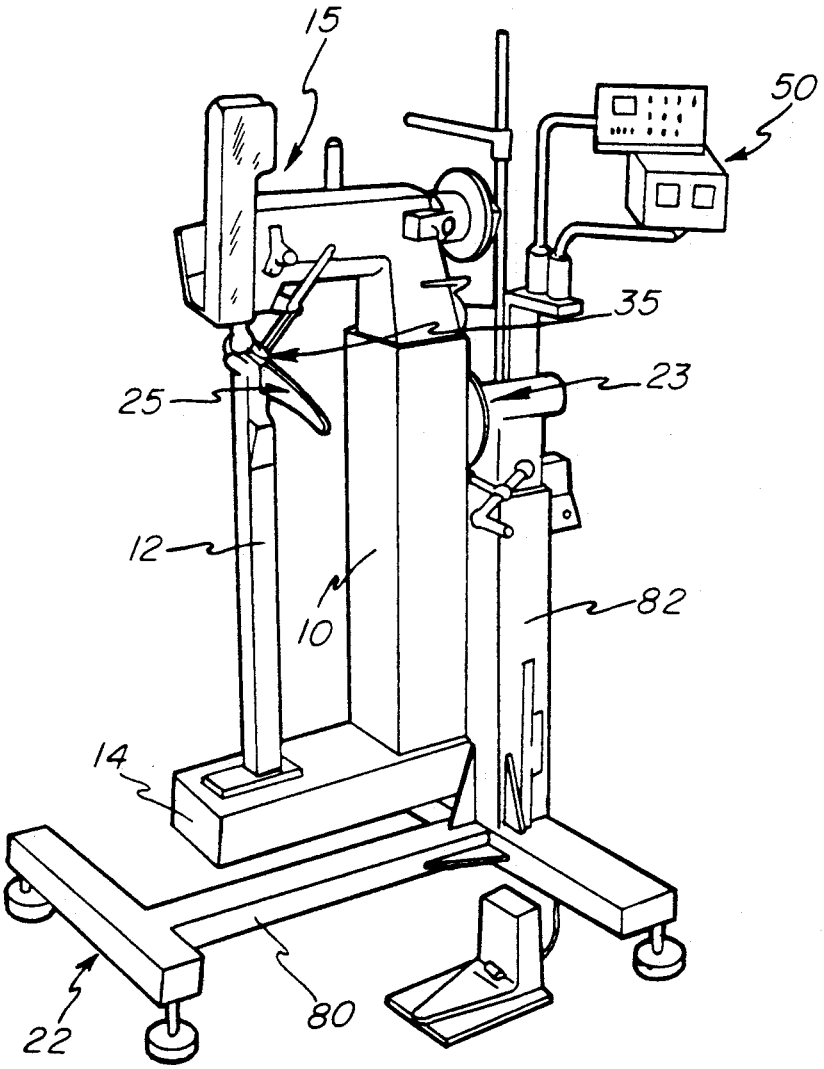
FIG. 1 is a perspective over-all view of the extended post sewing machine and its supporting pedestal, and the mounting cart for the machine on which the machine may be angularly and vertically adjusted, taken from the front of the machine.
Figure 2:
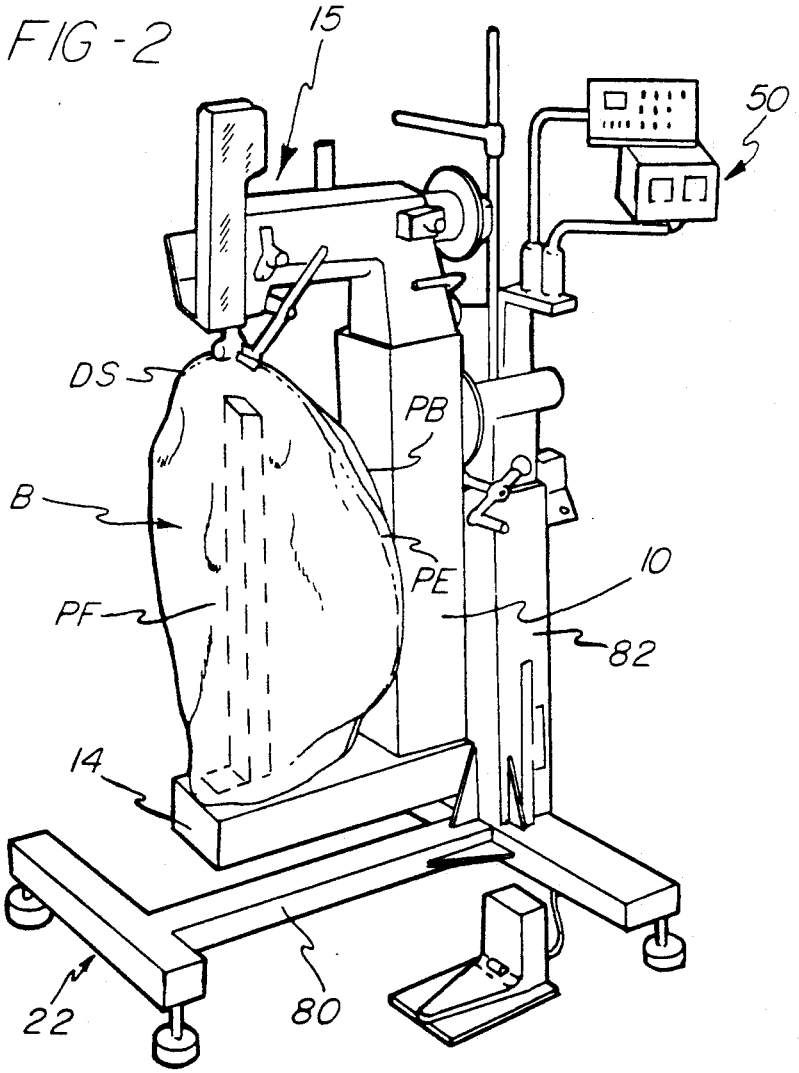
FIG. 2 is a view similar to FIG. 1, with the panels of an air bag shown draped over the extended post.
Figure 3:
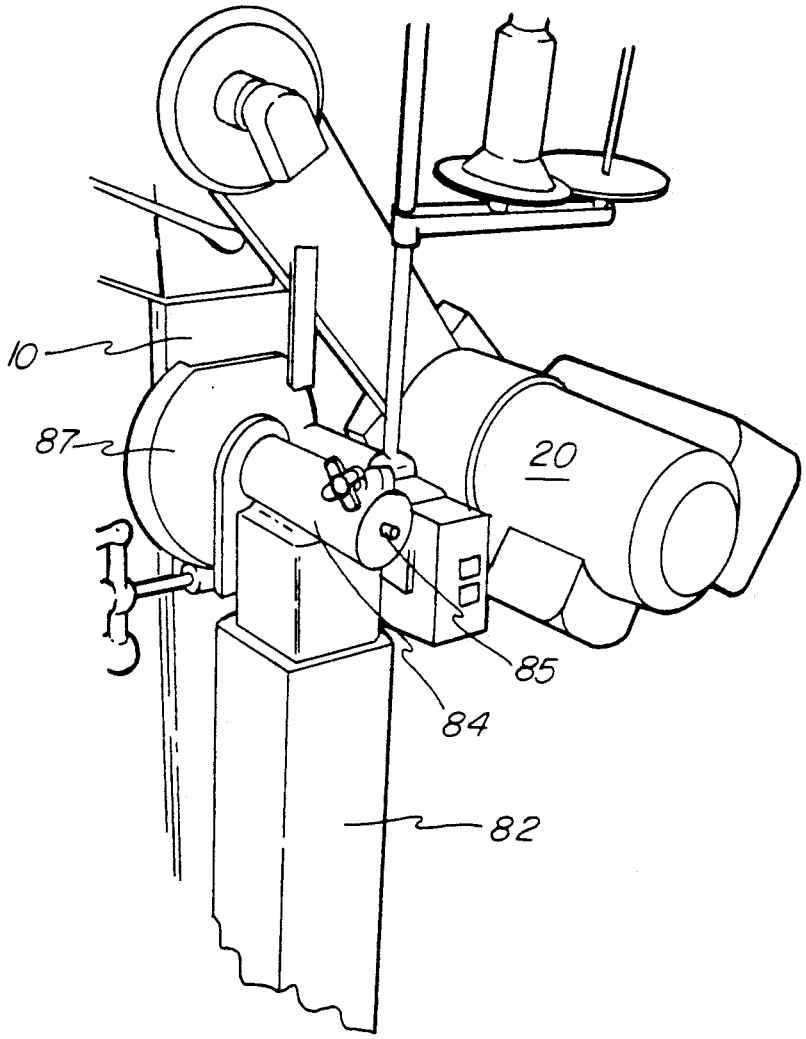
FIG. 3 is a partial perspective view taken from the right side of FIG. 1.

Referring to the drawings, and particularly to FIGS. 1, 2 and 3, a post-type sewing machine is shown having vertically extended pedestal 10 and stitching post 12 supported on a base 14, and in turn supporting and forming a mounting for a conventional sewing head 15, which includes a presser foot 16 and reciprocating power driven needle 17 (see FIG. 6), and a post plate 18 which includes the usual bobbin and reciprocably moving feed dog (not shown). A motor 20 provides rotary power for the sewing head and (through extended shafting not shown) for the parts within the post plate 18, in conventional fashion. The entire machine is mounted to a cart indicated generally at 22, having an adjustable connection at 23 to pedestal 10, which is later described. The front and back panels PF and PB of the bag B, which are already joined at a seam J, are received over post 12, which extends upward through the central opening CO in back panel PB, thus the joined panels are draped over and around the post, hanging generally vertically in a position whereby they can readily rotate around post 12 as the deck seaming proceeds.

It will be appreciated that the extension of pedestal 12 and post 10 is considerably greater, by a factor of approximately four, than previously known post machines. This unique configuration allows the draping of large pieces over the extended post, permits such pieces to be guided and fed automatically by minimizing their tendency to tangle, and contributes to the over-all efficiency of operations performed by this machine.

A lower fin-like guide plate 25 projects downwardly and forwardly from the top of post 12, and has an upper guiding edge 26 which fits the inside of the first seam or joint J in the panels, to space and align joint J with respect to presser foot 16. Plate 25 supports a section of the joint J between the plies, and the weight of the panels tends to hold them on this plate with joint J following the edge 26 as the panels are drawn through the sewing head.

Figure 4:
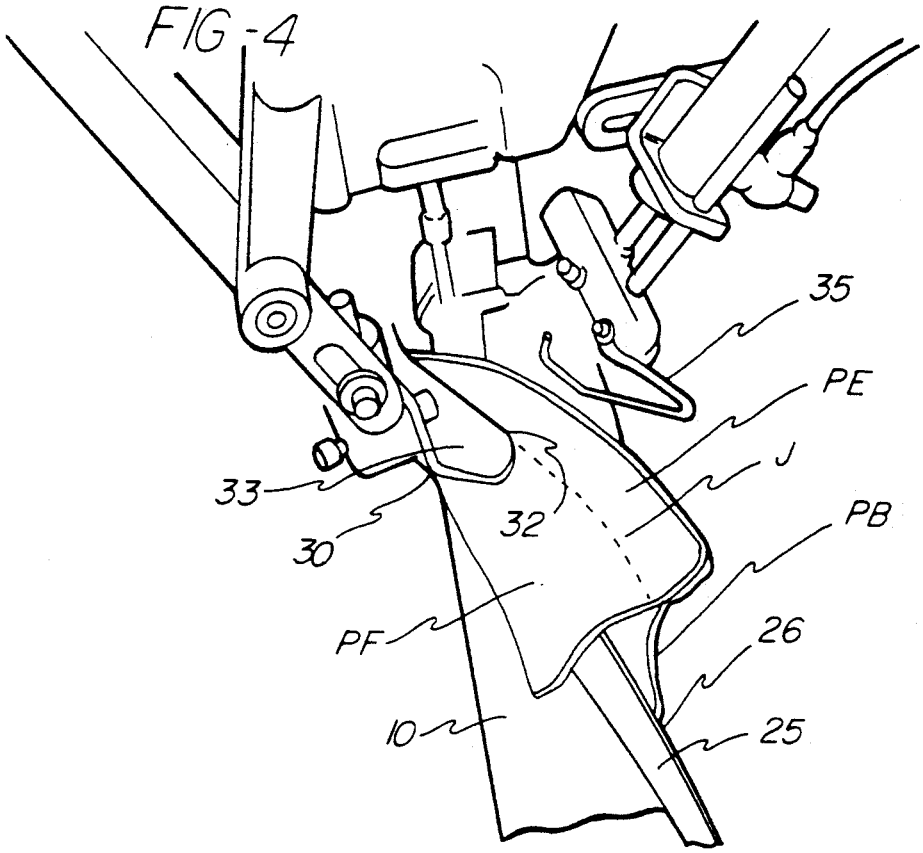
FIG. 4 is an enlarged partial perspective view showing a segment of the edges of the panels being placed between the side guides and into the sewing head.

A first retractable side guide plate 30 is supported at the side of the head opposite the lower guide plate, and functions to guide the adjoining peripheral bands or edge parts PE of Panels PF and PB onto the underlying part of front panel PF, as shown in FIG. 4. The so-called deck seam DS is then made in the head by sewing through all three layers of fabric. Guide plate 30 has an edge 32 which conforms generally to a portion of edge 26 of lower guide plate 25, and has a contoured upper surface 33 which receives the panel fabric edge parts PE and assists in placing them over the front panel PF just inside existing joint J between the panels.

A further or second retractable side guide 35 is supported at the opposite side of head 15 from guide plate 30, and functions to guide the peripheral edge parts PE onto surface 33 of retractable guide plate 30, and thus into precise alignment with the sewing head.

At the rear of the sewing head is a set of feed wheels 40 and 42, at least one of which has a knurled surface and is power driven through an oscillating shaft 45 (FIG. 7) of head 15, and which press the sewn periphery of the panels (e.g. edge part PE, joint J, and deck seam DS) between them, and pull that material through the sewing head in a uniform manner. This allows the presser foot 16 to be adjusted so as to exert a firm pressure against the panels and seams, without placing too heavy a load on the feeding dog mechanism associated with post plate 18. Shaft 45 has an arm 46 attached to it, and is connected via an adjustable rod 47 to a crank arm 48 which is in turn connected to drive wheel 40 (not shown in FIG. 7) in step-wise manner through a suitable one-way clutch (not shown).

Motor 20 is powered and controlled by a programmable controller, shown schematically at 50, which drives and controls the speed of the stitching motion of head 15. This controller can also be programmed to start and stop after a predetermined amount of fabric has passed through the head, thus the machine can be started and complete a deck seam around the panels of a bag, then stop automatically, without operator intervention. For example, the operator can start the job by entering the edge portion of the panels into the guide and feed mechanism, then the machine will proceed automatically and stop, leaving the last two to three inches of the seam to be completed by the operator who also then removes the bag from the machine.

Figure 5:
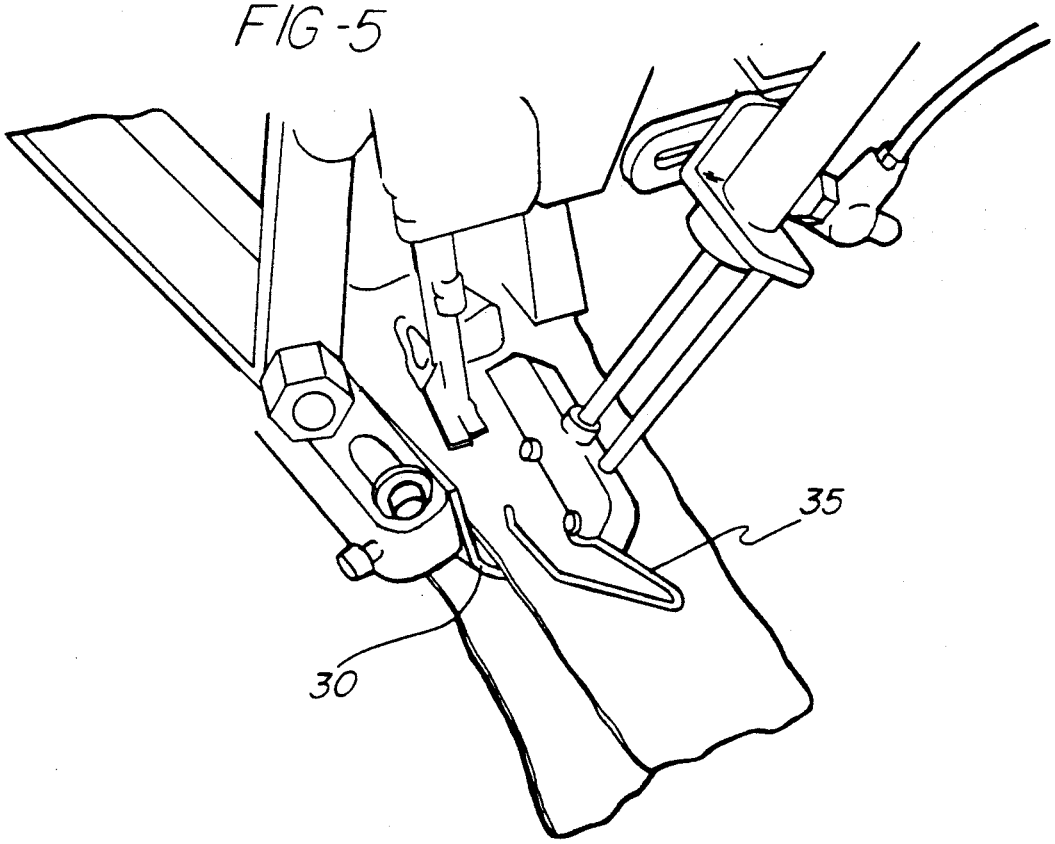
FIG. 5 is a view similar to FIG. 4, showing a portion of the panel edges in operative contact with the guides.
Figure 8:
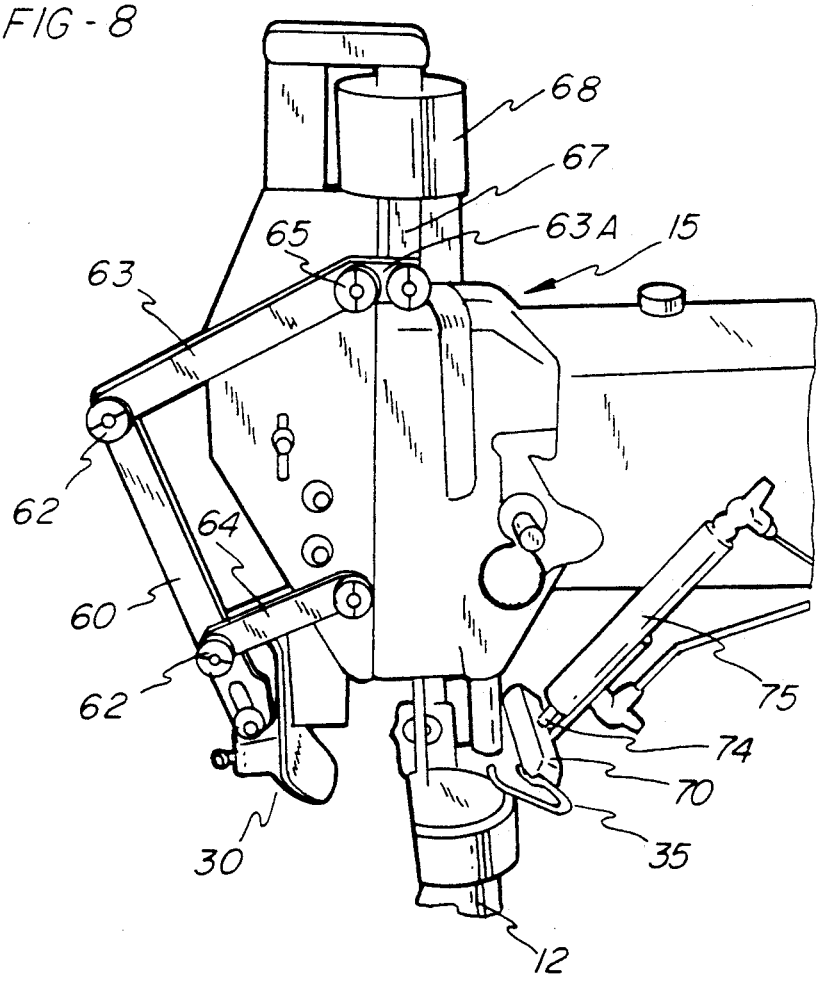
FIG. 8 is a frontal perspective view of the top of the head, showing the supporting structure which provides for retraction of the side guide members.

To provide for insertion/removal of work, and also for maintenance purposes, guide plate 30 is supported at the end of an arm 60 which is in turn attached by pivots joints 62 to upper and lower control arms 63 and 64. These arms are in turn pivotally supported at 65 to head 15, and an extended end 63A of upper arm 63 is pivotally attached to the output rod 67 of a pneumatic cylinder 68. Actuation of cylinder 68 will cause the arms to move plate 30, essentially as a parallel linkage system, between its lower active position (FIGS. 4 and 5) and its retracted position (FIG. 8).

Similarly, side guide 35 is attached to a support foot 70 by a screw 72, and foot 70 is fastened to the end of the rod 74 of a further pneumatic cylinder 75. Actuation of cylinder 75 will move guide 35 between its lower active position (FIGS. 4 and 5) and a withdrawn position as shown in FIG. 8.

Cart 22 includes a generally H-shaped base 80 and a vertically extending post 82 on top of which is a cross-mounted bearing support 84. This support holds a horizontally extending shaft 85 which is fixed at one end to machine pedestal 12, holding the base 10 of the machine suspended slightly above the pedestal base 80. A worm-/worm gear mechanism 87 is mounted on post 82 and connected between shaft 85 and that post, to allow rotational adjustment of the machine over the cart.

Thus, the invention provides a unique extended post type sewing machine which can handle automated, or partially automated, stitching of large, difficult to manipulate, fabric panels. The extended post unit receives joined panels, so as to project inside them, and includes both internal and external guides which align an existing seam in the panels with the sewing head, to assure accurate tracking when making an additional seam between the panels, e.g. a deck seam. The panels are held loosely and suspended from the post so they can move, and be automatically fed, through the sewing head with ease. This arrangement also makes it simple to load and unload work to and from the machine.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. In a sewing machine for making a deck seam in spaced relation to a previously formed joint between two plies of fabric, the combination of a sewing head and cooperating post plate for stitching together fabric plies fed therethrough, said post plate having forward and rear edges, a support for said head and said post plate, means including a motor for driving joined fabric plies through said head and post plate, a lower guide plate extending forward of said forward edge of said post plate and presenting an upper guiding edge for moving the joint of the fabric plies into predetermined alignment with said head as the joined fabric plies are fed through said head, a side guide plate supported over said lower guide plate and to one side of said head, said side guide plate having a guiding edge following said upper guiding edge of said lower guide plate and a surface for receiving and supporting the edges of the joined fabric plies entering said head, a second side guide member at the opposite side of said head from said side guide plate and adapted to fold the moving edges of the joined fabric plies onto said side guide plate as the plies enter said head.

2. A sewing machine as defined in claim 1, further including a vertically elongated post supporting said post plate and said guides, said lower guide plate providing a fabric support extending from said post forward of said head for holding the joined plies of fabric while allowing the plies to move progressively through said head.

3. A sewing machine as defined in claim 1, further including means supporting said second guide member for movement between a guiding position adjacent said lower guide plate and a retracted position withdrawn therefrom.

4. A sewing machine as defined in claim 1, further including means supporting said side guide plate for movement between a guiding position adjacent said lower guide plate and a retracted position withdrawn therefrom.

5. A sewing machine as defined in claim 1, wherein said driving means includes a driving wheel pressing against said fabric plies at the rear of said head and post plate to pull the joined plies of fabric through said head.

6. A sewing machine as defined in claim 5, further including a programmable control means connected to said motor to govern the driving time of said driving means whereby said driving means can stop automatically upon completion of a seam of predetermined length.

7. In a sewing machine adapted for making a deck seam in spaced relation to a joint between two round plies of fabric forming the front and back panels of an air bag, the combination of a sewing head and cooperating post plate for stitching together the joined edges of the bag panels to one of said panels to form a deck seam therebetween, said post plate having forward and rear edges, a support for said head and post plate including a base and a vertically elongated post extending upward from said base and connected to support said post plate thereon, means for driving joined fabric plies through said head including a driving wheel pressing against the seamed said fabric plies at the rear of said post plate to pull the joined the joined edges of the panel through said head, a motor connected to drive said sewing head, said driving wheel being driven from said sewing head at a predetermined speed synchronized to the sewing operation of said head, a lower guide plate extending forward of said forward edge of said post plate and presenting an upper guiding edge adapted to ride within and to guide the joint of the fabric plies into predetermined alignment with said head as the edges of the plies are fed through said head, an upper side guide plate supported over said lower guide plate and to one side of said head, said side guide plate having a guiding edge following said upper guiding edge of said lower guide plate and a surface for receiving and supporting the edges of the fabric plies entering said head, a second side guide member at the opposite side of said head and adapted to fold the moving edges of the joined panels onto said side guide plate as the joint of the panels enters said head.

8. A sewing machine for making a deck seam in spaced relation to a joint between two flexible fabric panels of an air bag, comprising a sewing head and post plate, a vertically extended pedestal supporting said sewing head and a corresponding vertically extended post supporting said post plate, said post being adapted to support the joined bag panels draped around said extended post and with the joint of said draped panels located between said sewing head and said post plate for stitching the edges of the panels to one of the panels while the remainder of the panels hang vertically around said post, a lower guide plate having an upper guiding edge extending forward from said post for engaging and supporting the interior of the joint between the panels and guiding the joint of the fabric plies into predetermined alignment with said head as the plies are fed through said head.

9. A machine as defined in claim 8, further including a side guide plate supported over said lower guide plate and to one side of said sewing head and post plate and having a surface receiving and supporting the edges of the fabric plies entering said head and also having a guiding and folding edge aligned with said head, and means for folding the moving edges of the joined fabric plies around said folding edge and onto the surface of said side guide plate as the plies are drawn into said sewing head.

10. A machine as defined in claim 9, including means supporting said side guide plate for movement toward and away from said plate to define an active and a retracted position for said side guide plate.

11. A method of making a deck seam in spaced relation to a previously formed joint between two flexible fabric plies forming panels of an air bag, comprising the steps of providing a sewing head and post plate supported on a vertically extended pedestal and post, respectively, draping the fabric panels between the sewing head and post plate for stitching the edges of the fabric plies to one of the plies as the previously formed joint is fed therethrough with the remainder of the panels hanging vertically around the post, engaging and supporting the interior of the joint between the panels with a guide plate having an upper guiding edge extending forward from the post for guiding the joint of the fabric plies into predetermined alignment with the head as the plies are fed through the head and post plate.

12. The method defined in claim 11, further including providing a side guide plate supported over the lower guide plate and to one side of sewing head and having a surface receiving and supporting the moving edges of the fabric plies entering the head and a guiding and folding edge aligned with the head, and fold the moving edges of the joined fabric plies around the folding edge and onto the surface of the side guide plate as the plies are drawn between the sewing head and post plate.

* * * * *